US005233953A

United States Patent [19]

Whitehurst et al.

[11] Patent Number: 5,233,953

[45] Date of Patent: Aug. 10, 1993

[54] HEAT SHIELD FOR A STARTER SOLENOID

[75] Inventors: James L. Whitehurst, Hartford City; Douglas R. Ogle, Muncie, both of Ind.

[73] Assignee: General Motors Corporation, Detroit, Mich.

[21] Appl. No.: 1,961

[22] Filed: Jan. 8, 1993

[51] Int. Cl.[5] ..... F02B 77/00

[52] U.S. Cl. ..... 123/198 E

[58] Field of Search ..... 123/198 E; 290/48; 335/278

[56] References Cited

PUBLICATIONS

Publication—1992 Chevrolet Light Duty Truck Unit Repair Manual—Title page and pp. 6D2-6 and 6D2-7; May, 1991.

*Primary Examiner*—Noah P. Kamen

*Attorney, Agent, or Firm*—Creighton R. Meland

[57] ABSTRACT

A heat shield for shielding the solenoid of an engine starter from heat generated by an internal combustion engine. The shield is formed of metal and has a first pair of deflectable spring arms for securing the heat shield to a solenoid of an engine starter. The arms have arcuate portions that are adapted to engage the case of the solenoid and the arms are deflected apart when the shield is assembled to the solenoid. The arms then spring back toward each other to tightly grip the solenoid. The heat shield has another pair of deflectable arms the end portions of which are adapted to engage fasteners that secure the shield to the drive housing of an engine starter. The heat shield has a deflectable spring finger that is adapted to engage the solenoid to prevent vibration of the heat shield.

11 Claims, 1 Drawing Sheet

HEAT SHIELD FOR A STARTER SOLENOID

This invention relates to a heat shield for the solenoid of an electric engine starter for shielding the solenoid from heat generated by an internal combustion engine.

When an engine starter is mounted on an internal combustion engine in such a position that the starter solenoid is located near the exhaust manifold of the engine, the solenoid is exposed to extreme temperatures. If the solenoid is not heat shielded, the solenoid may be heat damaged and the solenoid performance is reduced due to an increase in solenoid coil electrical resistance caused by the elevated temperature.

It is an object of this invention to provide a heat shield arrangement for a starter solenoid that does not use threaded fasteners for securing the heat shield to the starter. Thus, a heat shield made in accordance with this invention can be snapped onto the starter solenoid. More specifically, the heat shield of this invention is formed of spring steel material that has a pair of spring arms or legs that can be sprung apart to assemble the heat shield to the starter solenoid. These arms in the assembled position of the heat shield tightly engage opposed surfaces of the solenoid. The heat shield further has a spring finger or leg which in the assembled position of the heat shield engages an outer surface of the solenoid. In addition to the foregoing, the heat shield is provided with a pair of anti-turn arms or legs. These anti-turn arms or legs have end portions that engage the inside of fasteners that are used to secure the solenoid to a starter drive housing. In addition, the anti-turn arms are located between flanges that are respectively on the solenoid and drive housing to prevent the heat shield from moving axially relative to the solenoid.

DETAILED DESCRIPTION OF THE DRAWINGS

Figure 1:
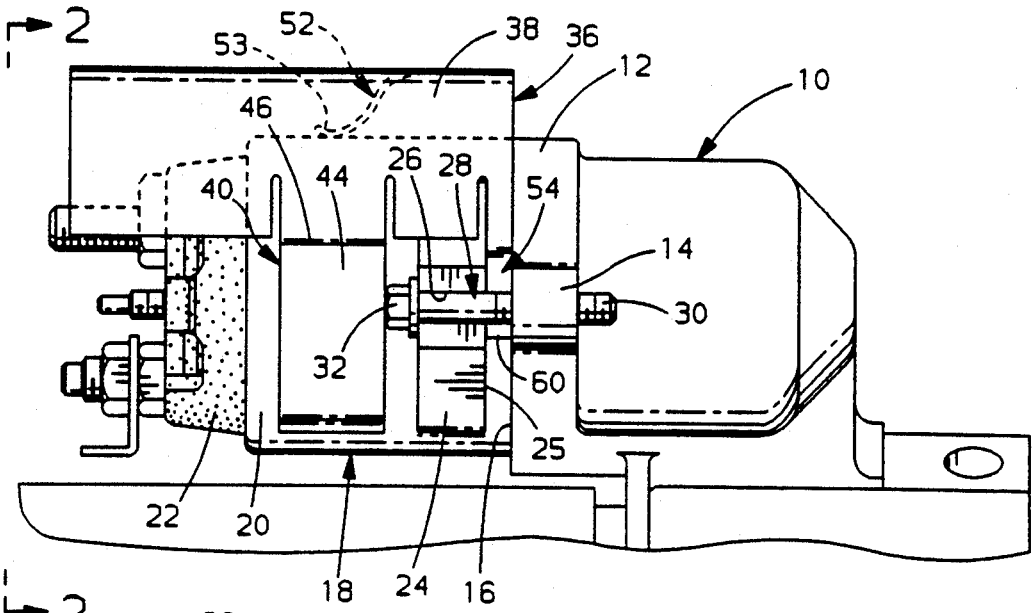
FIG. 1 is a side view of a portion of an electric engine starter showing a heat shield made in accordance with this invention secured to a starter solenoid.

Referring now to the drawings and more particularly to FIG. 1, a portion of an electric engine starter is illustrated. This engine starter has a drive housing 10 which contains a shift lever (not illustrated) that operates to move a pinion (not illustrated) into and out of mesh with the ring gear of an engine. The drive housing 10 has a radially extending flange 12 provided with opposed threaded bosses 14 and 15. The flange 12 has a surface 16 that faces a starter solenoid.

The engine starter has a solenoid generally designated as 18. The solenoid has an outer metallic case 20 that has an outer circular configuration. The solenoid further has an end cap 22 that is formed of electrical insulating material that supports terminals. The case 20 encloses a pull-in coil winding and a hold-in coil winding (not illustrated). These windings cooperate in a known manner with a solenoid plunger or armature (not illustrated) that has one end connected to the starter shift lever in a known manner.

Figure 2:
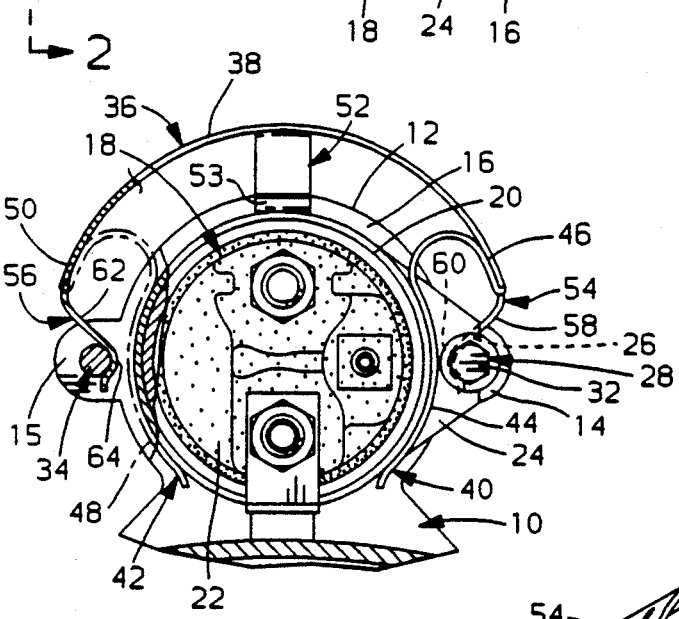
FIG. 2 is an end view partly in section and with parts broken away looking in the direction of the arrows 2—2 of FIG. 1.

The case 20 of solenoid 18 has two integral opposed radially extending flanges. One of these two flanges is shown in FIGS. 1 and 2 where it is designated as 24. The flange 24 has a surface 25 which faces the surface 16 of flange 12. Flange 24 has a semicircular groove or slot 26. A threaded fastener 28 is provided for securing solenoid 18 to drive housing 10. This fastener is shown in FIG. 2. The fastener 28 has a threaded portion 30 that is threaded into boss 14 on drive housing 10. The fastener 28 has a head 32 that engages a surface portion of flange 24. A portion of fastener 28 extends through the semicircular groove 26.

Another threaded fastener 34 is provided for securing the solenoid 18 to drive housing 10. The fastener 34 is identical to fastener 28 and it cooperates with a radially extending flange (not illustrated) that is identical to flange 24 and which is located opposite to flange 24. The fastener 34 has a threaded portion that is threaded into boss 15.

Figure 3:
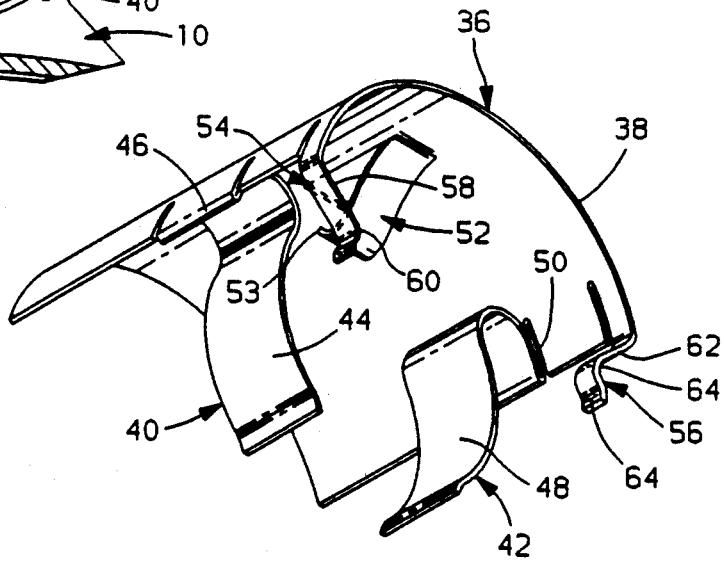
FIG. 3 is a perspective view of a heat shield made in accordance with this invention.

Referring now to FIG. 3, a heat shield made in accordance with this invention is illustrated. The heat shield is generally designated as 36. The heat shield 36 is formed of a heat treated spring steel material that may be about 1.0 mm. thick.

The heat shield 36 has a main axially extending heat shield portion 38. The portion 38 carries a pair of resilient spring arms 40 and 42 that are integral with portion 38. Arm 40 has a semicircular or arcuate portion 44 and a folded-over portion 46. Arm 42 has a semicircular or arcuate portion 48 and a folded-over portion 50.

The heat shield 36 further has a central depending resilient spring finger 52 that is integral with heat shield portion 38. The end portion 53 of spring finger 52 has a curved shape.

The heat shield 36 also has a pair of opposed resilient spring finger arms 54 and 56 that are integral with portion 38 and which are located adjacent one end of the heat shield. Arm 54 is comprised of a straight portion 58 and an arcuate or curved portion 60. In a similar fashion, arm 56 has a straight portion 62 and an arcuate or curved portion 64.

FIGS. 1 and 2 show the heat shield 36 assembled to the engine starter and the manner in which this is accomplished will now be described.

To assemble heat shield 36 to the starter, the arms 54 and 56 are aligned with the gaps between the surface 16 and the surfaces on the flanges of the case 20, like surface 25. The width of arms 54 and 56 is slightly less than the gap between the flanges, for example, the gap between flange surfaces 16 and 25. The arms are inserted into the just described gaps and through the spaces between a fastener, like fastener 34, and an outer surface of solenoid case 20. In the final assembled position of the arms 54 and 56, the arcuate portions 60 and 64 engage cylindrical surface portions of fasteners 28 and 34, as shown in FIG. 2. At the time that the arms 54 and 56 are being inserted into the gaps, the spring arms 42 and 44 are pushed onto the solenoid case 20 where they are forced apart by the solenoid case. The arms then spring back to a final assembled position where the inner surfaces of arcuate portions 44 and 48 engage the outer arcuate surface portions of case 20, as shown in FIG. 2. When the heat shield 36 is assembled, the end 53 of spring finger 52 engages an outer surface of case 20 and spring finger 52 is slightly deflected.

In the final assembled position of heat shield 36, the distance between arms 40 and 42 is greater than the distance between these arms prior to assembly. Thus, the diameter of case 20 is such that the arms 40 and 42 are deflected away from each other when they are assembled to case 20. The arms spring back thereby producing a spring-like force that maintains the arms in tight engagement with the case of the solenoid.

In the final assembled position of heat shield 36, the distance between the ends of arms 54 and 56 is less than the distance between the ends of these arms prior to assembly. Thus, as arms 54 and 56 are assembled to the solenoid, they are moved toward each other and then spring apart to a position where the end portions 60 and 64 respectively engage portions of the fasteners 28 and 34.

When heat shield 36 is assembled to the solenoid 18, the curved portion 53 of spring finger 52 engages the case 20 of the solenoid and the spring finger 52 is deflected. The spring force developed by the deflected spring finger 52 prevents vibration of the heat shield. It also develops a force tending to move heat shield 36 away from case 20. This force tends to cause the curved portions 60 and 64 of arms 54 and 56 to pull into tight contact with the fasteners and applies a force to arms 40 and 44 causing portions of these arms to be maintained in tight engagement with the solenoid case 20.

The arms 54 and 56 tend to prevent turning or rotation of the shield 36 relative to the solenoid. They also prevent axial movement of the heat shield relative to the solenoid. Thus, arms 54 and 56 are located in gaps between flange surface 16 and the flange surfaces like flange 25 or flange 24.

Arms 40 and 42 form the primary support for the heat shield.

Spring finger 52 operates to prevent vibration of the heat shield and develops a spring force that biases or tends to move the heat shield away from the solenoid.

In the final assembled position of the heat shield 36, as shown in FIG. 1, the heat shield portion 38 extends for the entire length of solenoid 18. More specifically, the heat shield portion 38 extends axially from surface 16 of flange 12 to a point beyond the other end of the solenoid. The starter is mounted on an engine in such a position that the heat shield portion 38 of heat shield 36 is located between the exhaust manifold of the engine and the solenoid. It, therefore, shields the solenoid from heat generated by the engine.

The embodiments of the invention in which an exclusive property or privilege is claimed are defined as follows:

1. An engine starter having a heat shield comprising in combination, an engine starter having a solenoid, said solenoid having a case that has an outer cylindrical surface, a metallic heat shield secured to said solenoid, said heat shield having a heat shield portion that is spaced from said case and which extends axially of said case to provide a heat shield for said solenoid, and means securing said heat shield to said case, said last named means comprising first and second opposed spring arms that are integral with said heat shield portion, each of said spring arms having an arcuate portion that respectively engage arcuate portions of said outer cylindrical surface of said case, said spring arms developing spring forces that tend to move said spring arms toward each other to tightly grip said case.

2. The engine starter according to claim 1 where said heat shield has an integral spring finger that engages a portion of the outer surface of said case, said spring finger developing a spring force that tends to move said heat shield away from said case.

3. The engine starter according to claim 1 where said heat shield portion has an arcuate shape.

4. An engine starter having a heat shield comprising in combination, an engine starter having a solenoid and a drive housing, said drive housing having a radially extending flange, a solenoid secured to said drive housing having a case, said case having radially extending case flange portions that are spaced from said housing flange, said case flange portions and said housing flange having opposed surfaces that define gaps therebetween, a pair of fasteners associated with said housing flange and with said case flange portions for securing said solenoid to said drive housing, said fasteners extending through said gaps, a metallic heat shield secured to said engine starter, said heat shield having a heat shield portion that is spaced from said case and which extends axially of said case, said heat shield having a first pair of spring arms that respectively engage surface portions of said case, said first pair of spring arms developing spring forces that tend to bias said first pair of spring arms toward each other to tightly grip said case, said heat shield having a second pair of spring arms that are axially spaced from said first spring arms, said second spring arms being located respectively in said gaps whereby said second spring arms prevent axial movement of said heat shield relative to said solenoid, the ends of said second spring arms respectively engaging portions of said fasteners to prevent said heat shield from rotating relative to said solenoid.

5. The engine starter according to claim 4 where said heat shield portion has an arcuate shape.

6. The engine starter according to claim 4 where said heat shield has integral spring finger that engages a portion of the outer surface of said case, said spring finger developing a spring force that tends to bias said heat shield away from said case.

7. A heat shield formed of metallic material that is adapted to be secured to the solenoid of an engine starter to shield the solenoid of the starter from engine generated heat comprising, an axially extending heat shield portion, first and second opposed spring arms extending from said heat shield portion that are integral with said heat shield portion, said spring arms having internal surfaces that are adapted to engage outer surface portions of a solenoid to secure the heat shield to the solenoid, said spring arms being resilient and deflectable away from each other to permit said arms to be sprung apart when they are fitted to said solenoid, said arms providing a spring force for maintaining the arms engaged with said solenoid.

8. The heat shield according to claim 7 where said spring arms each have an arcuately shaped portion that are adapted to engage outer surfaces of a solenoid.

9. The heat shield according to claim 7 where said heat shield has a deflectable spring finger that is adapted to engage a solenoid, said spring finger being integral with heat shield portion.

10. A heat shield formed of metallic material that is adapted to be secured to the solenoid of an engine starter to shield the solenoid of the starter from engine generated heat comprising, an axially extending heat shield portion, a first pair of opposed spring arms extending from said heat shield portion, said spring arms having internal surfaces that are adapted to engage outer surface portions of a solenoid to secure the heat shield to the solenoid, said spring arms being resilient and deflectable away from each other to permit said arms to be sprung apart when they are fitted to said solenoid, said arms providing a spring force for maintaining the arms engaged with said solenoid, and a second pair of opposed spring arms extending from said heat shield portion that are integral with said heat shield portion, said second pair of spring arms being axially spaced from said first pair of spring arms, said second pair of spring arms each having an end portion that is adapted to engage a fastener that secures said solenoid to a starter drive housing.

11. The heat shield according to claim 10 where said heat shield has a deflectable spring finger that is adapted to engage a solenoid, said spring finger being integral with said heat shield portion.

* * * * *